US007604481B2

(12) United States Patent
Owen et al.

(10) Patent No.: US 7,604,481 B2
(45) Date of Patent: Oct. 20, 2009

(54) WHITE BOARD AND WHITE BOARD DISPLAY SYSTEM

(75) Inventors: Michael Owen, S. Lake Tahoe, CA (US); Duane D. Adams, Sydney, NY (US)

(73) Assignee: MeadWestvaco Corporation, Glen Allen, VA (US)

( * ) Notice: Subject to any disclaimer, the term of this patent is extended or adjusted under 35 U.S.C. 154(b) by 549 days.

(21) Appl. No.: 11/037,979

(22) Filed: Jan. 18, 2005

(65) Prior Publication Data

US 2005/0191611 A1 Sep. 1, 2005

Related U.S. Application Data

(63) Continuation-in-part of application No. 10/759,540, filed on Jan. 16, 2004, now abandoned.

(51) Int. Cl.
*B43L 1/00* (2006.01)

(52) U.S. Cl. ..... 434/408

(58) Field of Classification Search ..... 434/408
See application file for complete search history.

(56) References Cited

U.S. PATENT DOCUMENTS

| | | | | |
|---|---|---|---|---|
| 147,267 | A | 2/1874 | Hunt | |
| 258,635 | A | 5/1882 | Elliott | |
| 317,566 | A | 5/1885 | Pattberg | |
| 627,396 | A | 6/1899 | Daly | |
| 1,099,748 | A | 6/1914 | Hopkins | |
| 2,639,526 | A | 6/1953 | Bepristis | |
| 2,891,326 | A | 6/1959 | Fransson | |
| 3,531,898 | A | 10/1970 | Facemire | |
| 3,554,429 | A | 1/1971 | Cohen | |
| 3,914,890 | A | 10/1975 | Behlen, Jr. | |
| 4,010,553 | A * | 3/1977 | Bennett | 434/338 |
| 4,478,331 | A | 10/1984 | Ruin | |
| 4,716,693 | A | 1/1988 | Webster | |
| 4,746,009 | A | 5/1988 | Liberman | |
| 4,828,502 | A | 5/1989 | Leahy | |
| 4,991,333 | A | 2/1991 | McLean et al. | |
| 5,035,626 | A * | 7/1991 | Persing | 434/408 |
| 5,163,845 | A * | 11/1992 | Blassingame | 434/408 |
| 5,176,522 | A | 1/1993 | Robertson | |
| 5,263,866 | A | 11/1993 | Campbell | |
| 5,330,084 | A | 7/1994 | Peters | |
| 5,494,442 | A | 2/1996 | Hecht | |
| 5,513,746 | A | 5/1996 | Anderson | |
| 5,518,217 | A * | 5/1996 | Deutsch et al. | 248/463 |
| 5,649,828 | A * | 7/1997 | Kawashima | 434/411 |
| 5,658,635 | A * | 8/1997 | Davis et al. | 428/81 |
| 5,720,464 | A * | 2/1998 | Meinscher et al. | 248/447 |
| 5,827,072 | A | 10/1998 | Neufer et al. | |
| 5,865,627 | A | 2/1999 | Foresman | |
| 5,941,713 | A | 8/1999 | Wayner et al. | |
| 5,987,825 | A | 11/1999 | Rosen | |
| 6,139,331 | A | 10/2000 | Owen | |

(Continued)

*Primary Examiner*—Gene Kim
*Assistant Examiner*—Dolores Collins
(74) *Attorney, Agent, or Firm*—Alison R. Scheidler; Donald G. Bauer

(57) ABSTRACT

The present invention provides a writing board system including several white boards and a frame for mounting to a vertical surface 20. The white boards may be removably interconnected to one another and supported to the frame by a series of mounting brackets.

25 Claims, 8 Drawing Sheets

U.S. PATENT DOCUMENTS 6,155,325 A * 12/2000 Schirer ..... 160/135
6,170,792 B1 * 1/2001 Miceli et al. ..... 248/441.1
6,523,858 B2 2/2003 Takemura
6,626,675 B1 9/2003 Webber
6,647,652 B1 11/2003 Seiber et al.
6,666,424 B2 * 12/2003 Richardson ..... 248/460
6,736,644 B1 5/2004 Vaughn
6,895,704 B2 * 5/2005 Ives et al. ..... 40/493
6,971,703 B2 * 12/2005 Sturt et al. ..... 296/97.5
2005/0191611 A1 * 9/2005 Owen et al. ..... 434/408

* cited by examiner

WHITE BOARD AND WHITE BOARD DISPLAY SYSTEM

CROSS-REFERENCE TO RELATED APPLICATION

The present application is a continuation-in-part of U.S. patent application Ser. No. 10/759,540, filed Jan. 16, 2004 now abandoned, entitled Board System, the specification of which is hereby incorporated by reference.

BACKGROUND OF THE INVENTION

The present invention relates to a system for displaying a board and housing several boards. More particularly, the present invention relates to a board system that provides for the easy removal of several boards from a storage device.

The use of erasable boards for presentations is known. Such boards include chalkboards, such as blackboards and greenboards, and white boards. For ease in presenting and storing data, individuals have come to rely on several boards instead of just one board fastened to a wall.

The prior art has presented several options for a user of boards. In U.S. Pat. No. 3,531,898 to Facemire, a plurality of display boards are suspended for sliding along a track In U.S. Pat. No. 3,914,890 to Behlen, Jr., a plurality of display panels or signs are mountable within tracks formed in parallel upstanding side posts. In U.S. Pat. No. 4,716,693 to Webster, the structure includes details of roller assemblies used for movably supporting a sign or panel along a track. In U.S. Pat. No. 6,139,331 to Owen, a board base apparatus provided both storage and display of board panels using slots or tracks.

Each of these prior art storage and display units includes tracks in order to store the boards. However, inserting and removing the boards from the units can be difficult because each board must fit into a narrow track in order to properly hold the board. These units are difficult to work with and are expensive.

SUMMARY OF THE INVENTION

The present invention provides a writing board system essentially comprising several white boards and a frame for mounting to a vertical surface 20. The white boards may be removably interconnected to one another and supported to the frame by a series of mounting brackets. The mounting brackets include a first channel that is positioned over a leg of the frame and securely connected thereto via a bolt and nut and a second channel oriented in the opposite direction from the first channel that is positioned in supporting relation to the white boards. To ensure a high level of support, it is contemplated that mounting brackets would be positioned at the bottom of the boards and frame, as well on each of the sides of the boards and frame.

The present invention further includes the use of index tabs that may be removably mounted on any of the white boards for purposes of identifying a topic or otherwise distinguishing one board from another. The white boards include trim that extends around the periphery of the writing surfaces and the trim's outwardly facing surface includes a channel formed therein. The index tabs are adapted to be securely positioned within these channels.

The present invention further includes handles that may be removably connected to any or all of the boards. The handle can also be used to clampingly secure a wall mounting bracket to the board, thereby permitting secure fixation of a board on a wall.

The present invention further includes an adjustable mounting bracket that permits the frame to be supported on a vertical structure, such as a cubicle wall or a door. The mounting bracket includes a first member secured to the frame and a second member adjustably connected thereto. Collectively, the two members define a U-shaped bracket that may be hung on the top edge of a wall or door. Elongated slots formed in the overlying portions of the two members permit the width of the bracket to be adjusted to accommodate vertical structures of varying widths.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
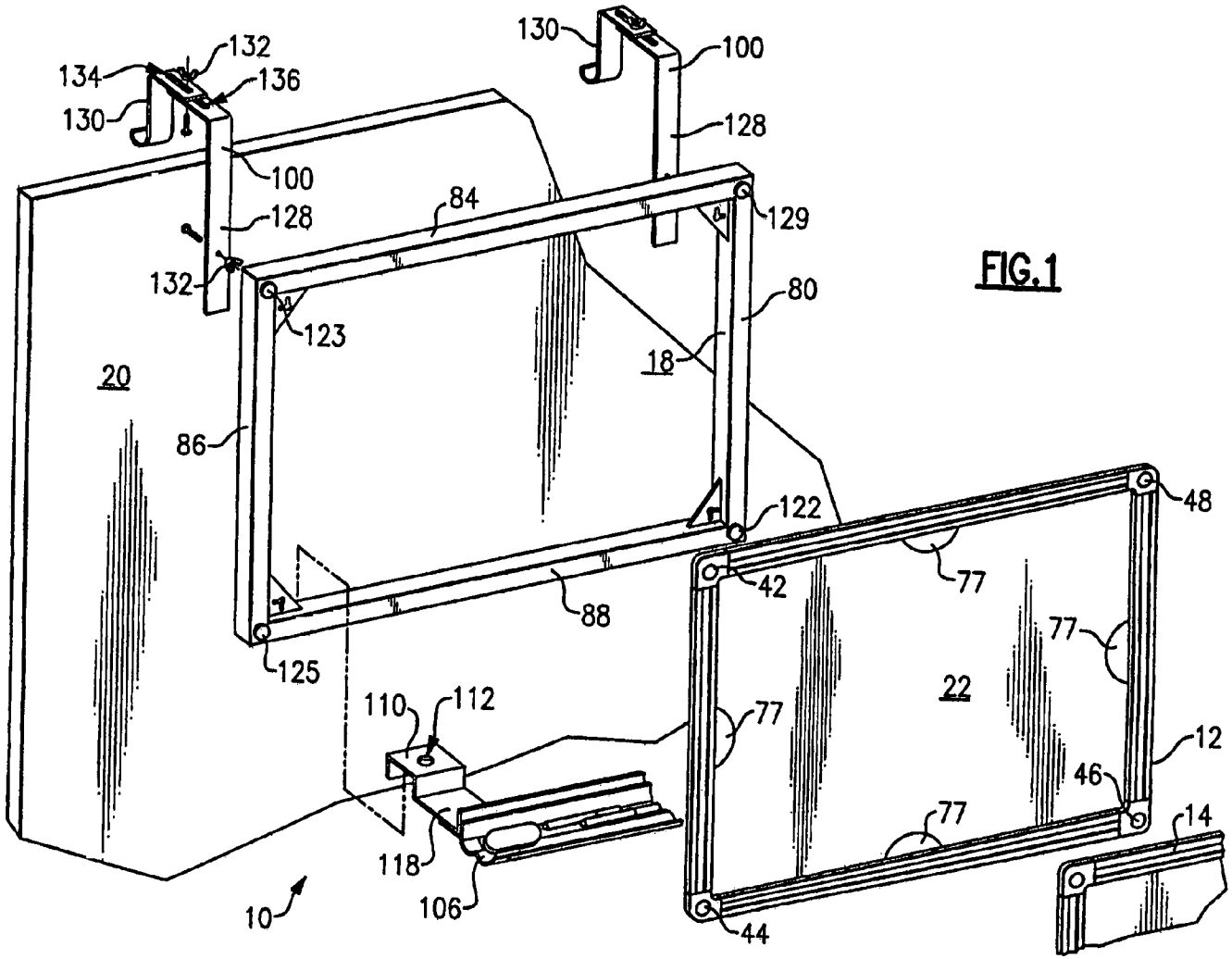
FIG. 1 is an exploded perspective view of the white board system of the present invention.
Figure 2:
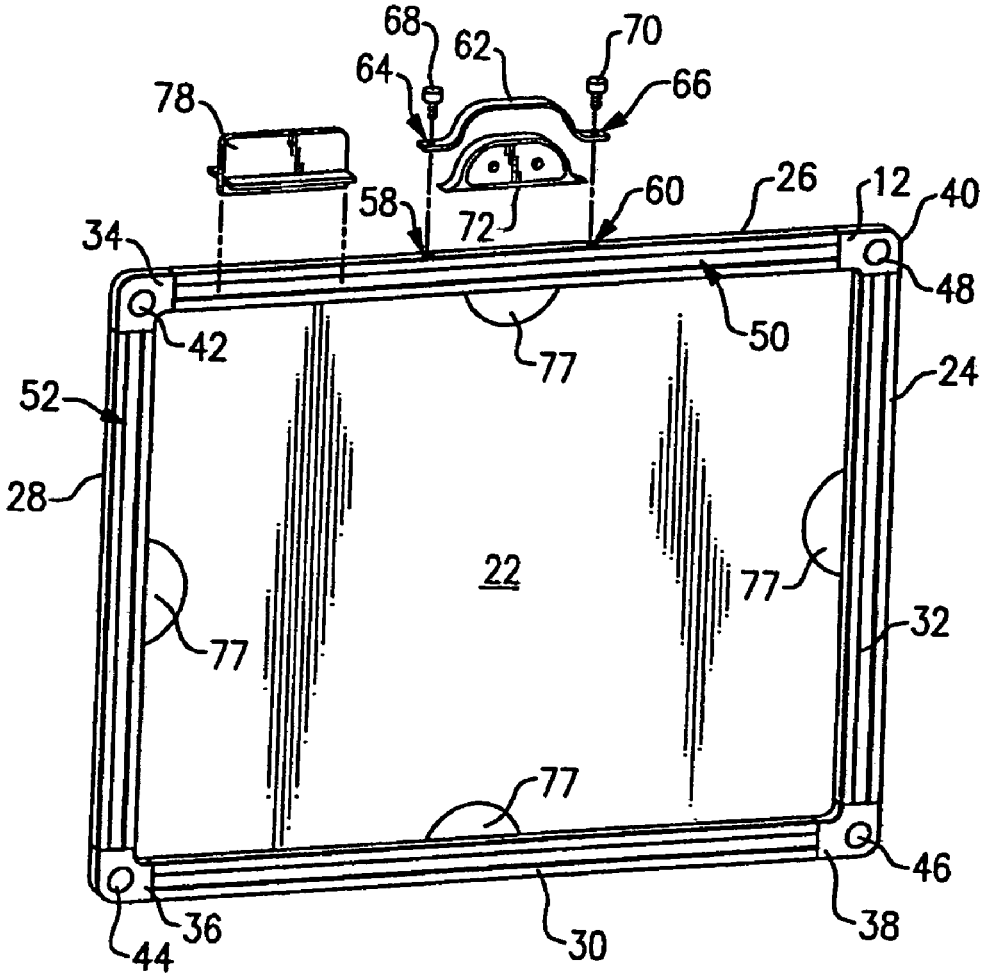
FIG. 2 is a fragmentary, exploded perspective of a series of boards.
Figure 3:
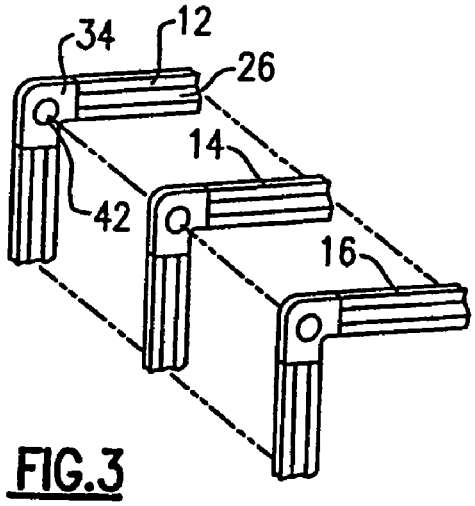
FIG. 3 is an exploded perspective of a single white board.
Figure 4:
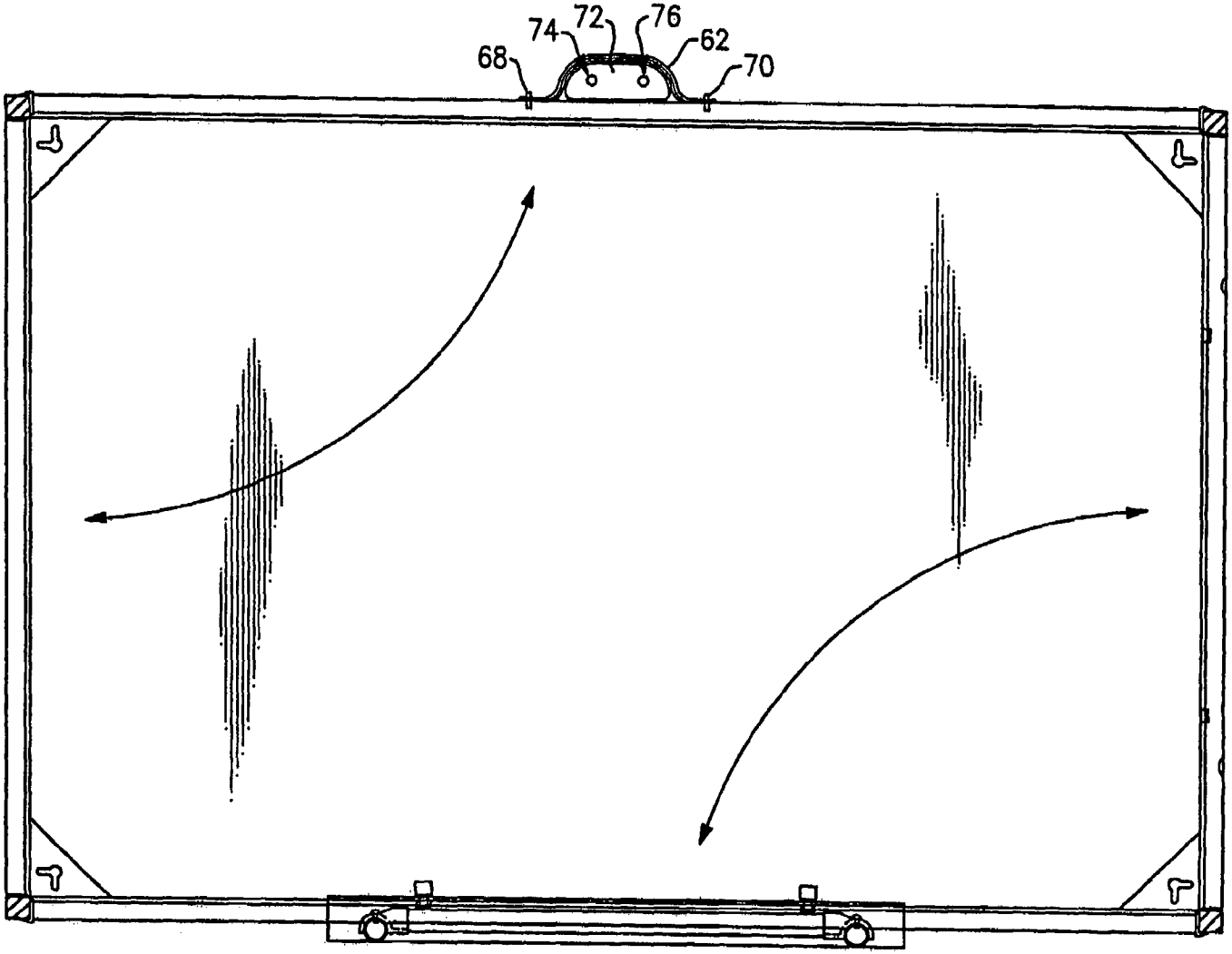
FIG. 4 is a rear elevation of the white board system of the present invention.
Figure 5:
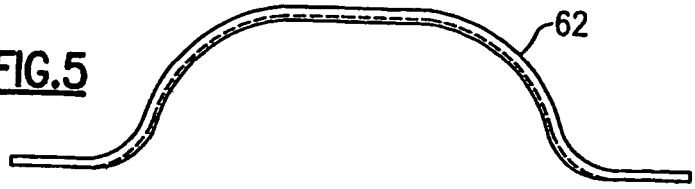
FIG. 5 is a front elevation view of the handle of the present invention.
Figure 6:
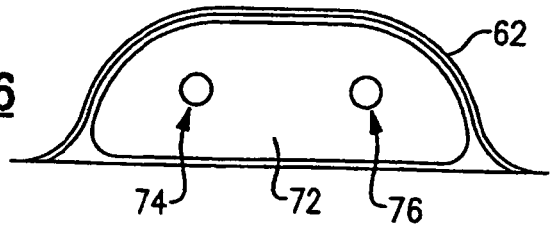
FIG. 6 is a front elevation view of the handle and wall mounting bracket of the present invention.
Figure 7A:
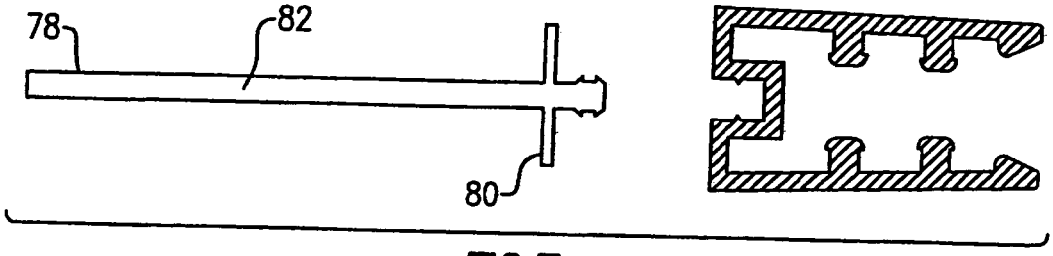
FIGS. 7*a*-7*d* are cross-sectional, top plan, front elevation, and side elevation views of the index tab of the present invention.
Figure 7B:
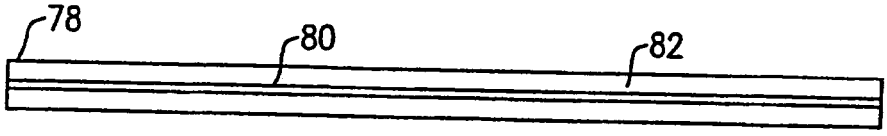
Figure 7C:
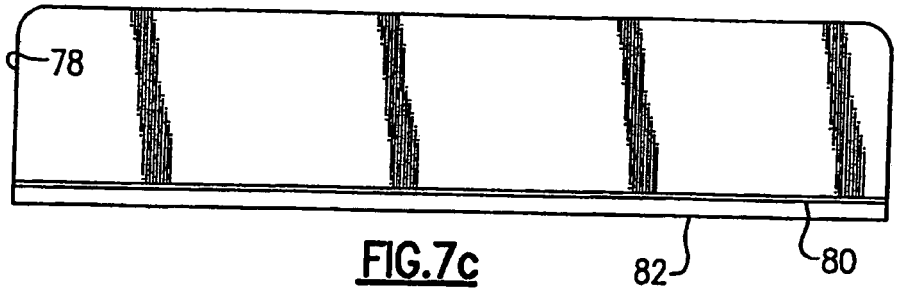
Figure 7D:
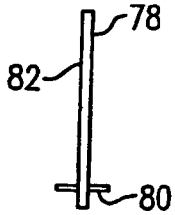
Figure 8:
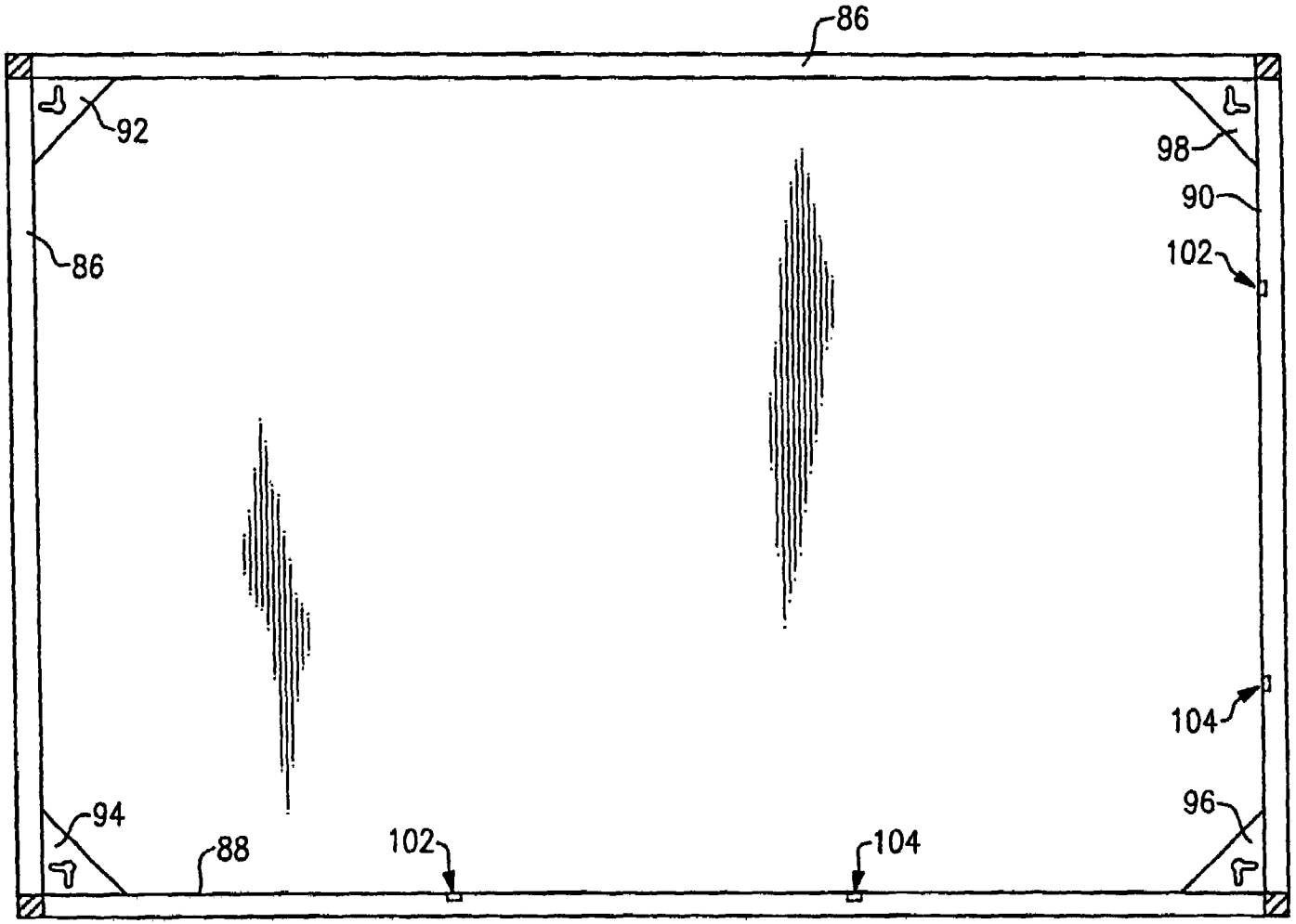
FIG. 8 is a front elevation view of the frame of the present invention.
Figure 9A:
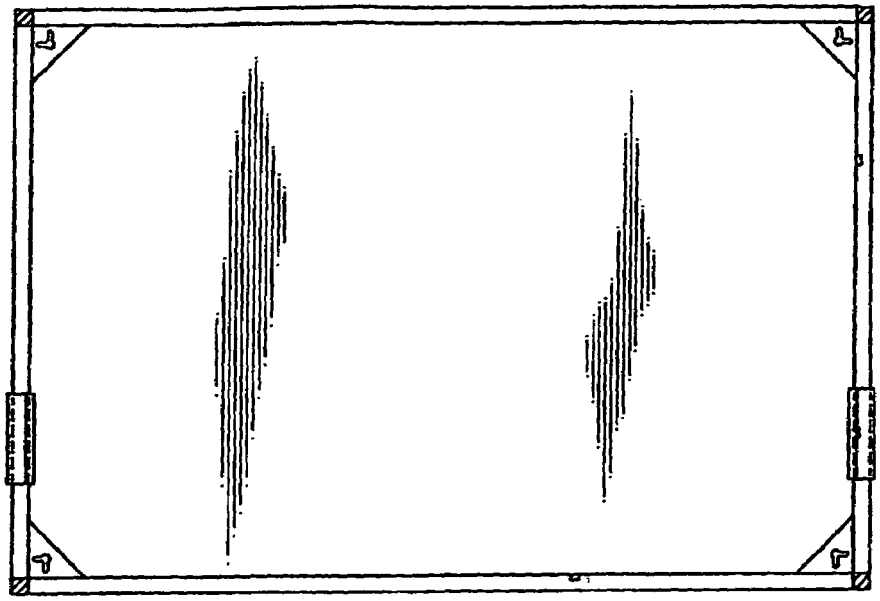
FIGS. 9*a* and 9*b* are both front elevation views of the frame and board support brackets of the present invention.
Figure 9B:
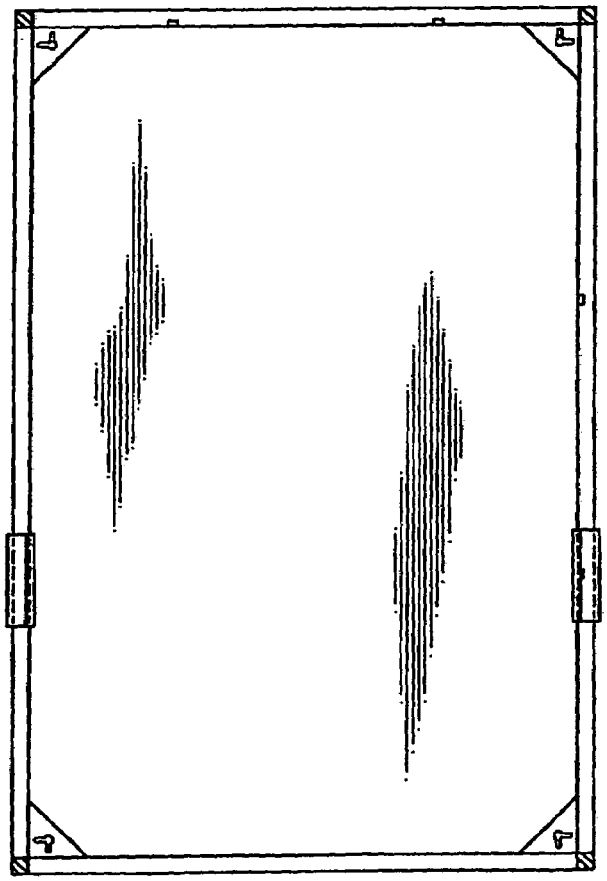
Figure 10G:
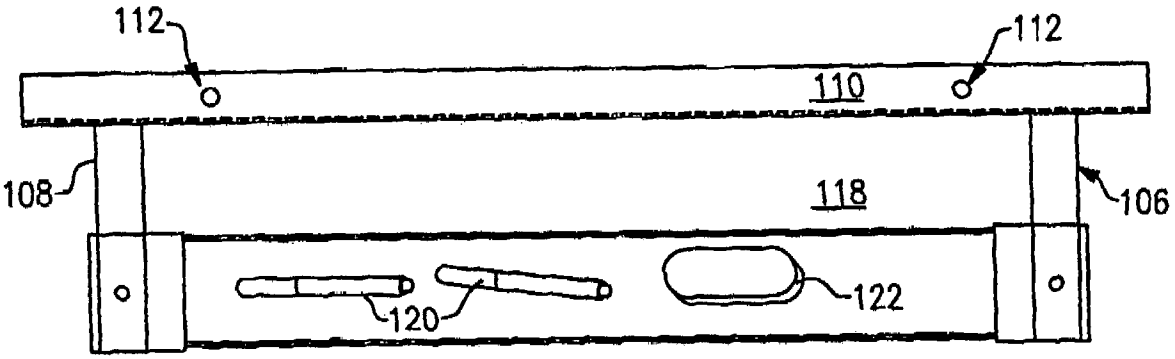
FIGS. 10*a*-10*c* are top plan, front elevation, side elevation, and cross-sectional views of the accessory tray that goes with the board system of the present invention.
Figure 10B:
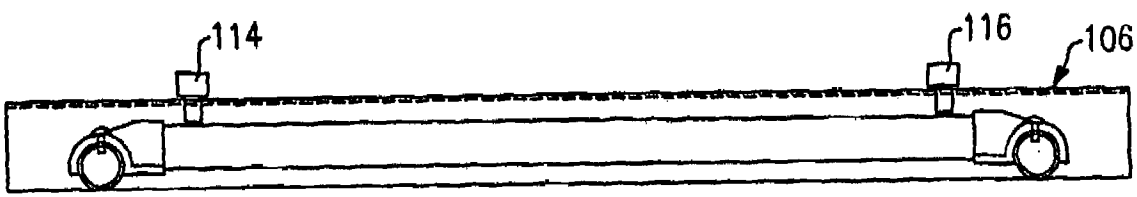
Figure 10C:
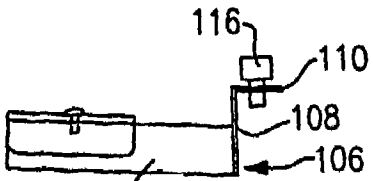
Figure 11A:
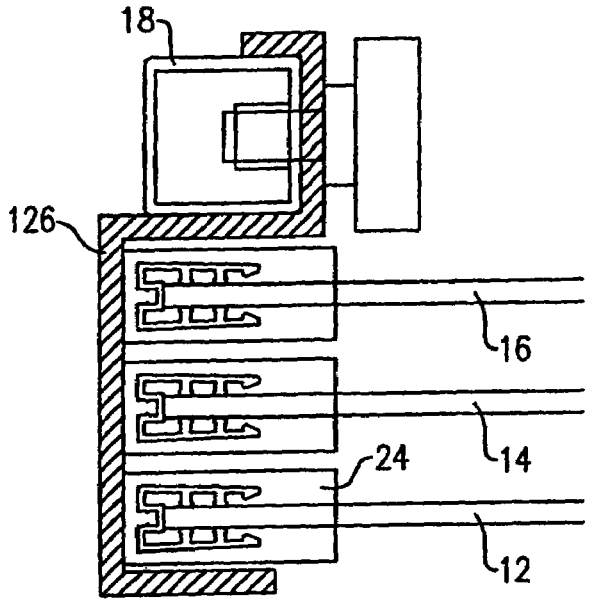
FIGS. 11*a* and 11*b* are cross-section and top plan views of support brackets of the present invention.
Figure 11B:
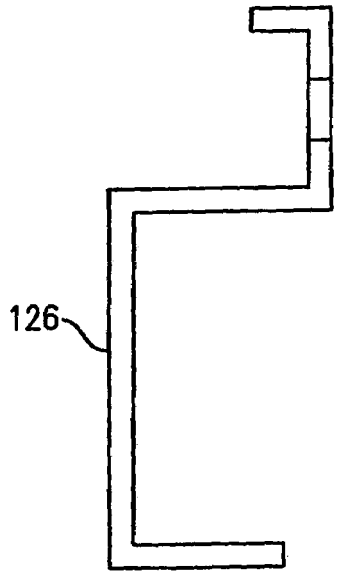

Referring now to the drawings, in which like reference numerals refer to like parts throughout, there is seen in FIGS. 1-3 a writing board system, designated generally by reference numeral 10, essentially comprising several white boards 12, 14, 16, and a frame 18 for mounting to a vertical surface 20. It should be understood that system 10 may be used in connection with a single white board or any additional number of boards and that the number shown in the figures is for illustrative purposes only. In addition, the term "white board" is used for sake of convenience, but it should be understood that the term encompasses any type of board panel containing a substrate adapted to be written upon or have items displayed thereon, all of which are well known in the art.

With reference to FIGS. 1-3, board 12 includes opposing planar surfaces 22 either or both of which can be written upon, and trim 24 extending substantially fully around the periphery of surfaces 22. Trim 24 comprises elongated legs 26, 28, 30, and 32 that are interconnected to one another about the periphery of surfaces 22 by corner connectors 34, 36, 38, and 40. Due to the rectangular periphery of board 12, as illustrated, there are four legs and four corner pieces. It should be appreciated that the periphery of board 12, and hence trim 24, can be any shape and rectangular is simply illustrated for sake of convenience.

Corner connectors 34, 36, 38, and 40 are each equipped with board fastening elements 42, 44, 46, and 48, respectively, positioned on each of their opposite, outwardly facing surfaces. Fastening elements 42, 44, 46, and 48 can be any conventional fastener, such as pile fabric, hook fabric, snaps and snap receivers, magnets, or the like, and serve to interconnect a plurality of boards together such that each board extends in parallel planes and in overlying relation to the adjacent board.

Legs 26, 28, 30, and 32 each include an elongated channel 50, 52, 54, and 56, respectively, formed therein and extending longitudinally there along. A pair of internally threaded openings 58, 60, are formed in each leg 26, 28, 30, and 32, and are laterally spaced relative to one another equidistant from each leg's midpoint.

A U-shaped handle 62 is provided that can be interconnected to board 12. Handle 62 includes a pair of holes 64, 66, formed through its opposite ends. Thumb screws 68, 70, or an equivalent fastener, pass through holes 64 and 66, and into openings 58, 60, (or 58'. 60') respectively, where they threadingly terminate and securely interconnect handle 62 to board 12.

If it is desired to mount board 12 on a wall, a mounting block 72 can be used. Mounting block 72 is essentially U-shaped, corresponding in outline to handle 62, and may be clampingly secured between handle 62 and board 12. A pair of laterally spaced openings 74, 76, are formed through block 72 and provide a mounting means that is secure and resists rotation. It should be noted that the board can be mounted either vertically or horizontally due to holes 58, 60 (on each of the long ends of board 12) or 58', 60' (formed in both short ends of board 12).

Surfaces 22 further include a series of fins 77 that are securely connected thereto along their base edges, but are not otherwise secured to surface 22. Preferably fins 77 are composed of a plastic or similar flexible material that may lie flat against surface 22. The purpose of fins 77 is to permit sheet material such as papers, laminated papers, posters, maps, presentations, calendars, placards, signage, wall planners, and pictures to be positioned between the fins and surface 22, thus securely positioning the sheet material on board 12.

As system 10 contemplates use of multiple boards, the use of index tabs proves useful. Thus, the present invention provides index tabs 78 that may be written upon or otherwise used in a manner to identify topics on different boards. Index tabs 78 are t-shaped in cross section, as seen in FIGS. 7*a*-7*d*, with the cross member 80 being positioned closer to one end of the leg member 82 than the other. The shorter leg member 82 is adapted for secure placement within any of channels 50, 52, 54, or 56, thereby leaving the longer of leg members 82 exposed and therefore capable of being viewed.

Frame 18 comprises a rectangular array of legs 84, 86, 88, and 90, and is preferably composed of a suitable, predominantly rigid material, such as aluminum. Mounting cornices 92, 94, 96, and 98 are positioned at the intersection of the leg members, and provide a plate that can be used for mounting frame 18 on a wall or as an interconnect point for a mounting bracket 100 that may be used to mount frame 18 on a cubicle or door.

The inwardly facing surfaces of each leg 84, 86, 88, and 90 include a pair of laterally spaced apart openings 102, 104 formed therein. An accessory tray 106 is attached to a pair of S-shaped mounting brackets 108 that each include a first, downwardly facing channel 110 adapted for placement over one of legs 84, 86, 88, and 90, with an opening 112 formed therethrough. Once channel 110 is placed over one of legs 84, 86, 88, or 90, holes 112 are aligned with openings 102 and 104, and fastening screws (or knurled knobs) 114, 116 are inserted through the holes and tightened, thereby securely interconnecting tray 106 to frame 18.

Mounting bracket 108 further includes a second, upwardly facing channel 118 that is adapted to receive and removably support one or more of boards 12, 14, and 16 therein. The tray 120 is attached to and extends forwardly from second channel 118. Markers 121 and/or erasers 122 may be placed in tray for easy access by a user of system 10.

To provide further support to boards 12, 14, 16 that may be supported along their bottom edges by bracket 108, a pair of S-shaped brackets 126 that are for all intents and purposes identical to the S-shaped bracket 108 (but without the tray 120), may have their first channel interconnected to whichever of legs 84, 86, 88, and 90 happen to be oriented to the sides, and their second channels positioned in supporting relation to boards 12, 14, and 16. By supporting boards 12, 14, and 16 along all three sides, it is highly unlikely that one of the boards will fall from frame 18 and potentially break or cause injury to a person in proximity to system 10.

To further support boards 12, 14, 16 while in frame 18, the corner intersections of the front surfaces of legs 84, 86, 88, and 90 are provided with a suitable fastener 123, 125, 127, and 129 that corresponds with fasteners 42, 44, 46, and 48, such that the rear-most board supported by frame 18 will be removably fastened to frame 18 through the cooperation of fasteners 123, 125, 127, and 129 with fasteners 42, 44, 46, and 48. Thus, fasteners 123, 125, 127, and 129 can be hook fabric, pile fabric, magnets, or snap/snap receivers, or any equivalent thereof.

As indicated previously, mounting bracket 100 may be used to mount frame 18 to a cubicle, door, or similar vertical structure. Bracket 100 includes a first L-shaped member 128 adapted to be connect to one of the cornices 92, 94, 96, or 98, via a nut and bolt or similar fastening arrangement, and a second L-shaped member 130 adjustably connected to first L-shaped member 128 via a wing nut 132. Both L-shaped members 128, 130 include elongated slots 134, 136, respectively, formed through the legs that overlap to interconnect the two. Thus, the width separating the two L-shaped members is adjustable thereby permitting bracket 100 to be used to mount frame 18 to a vertical structure having a variable width.

Figure 12:
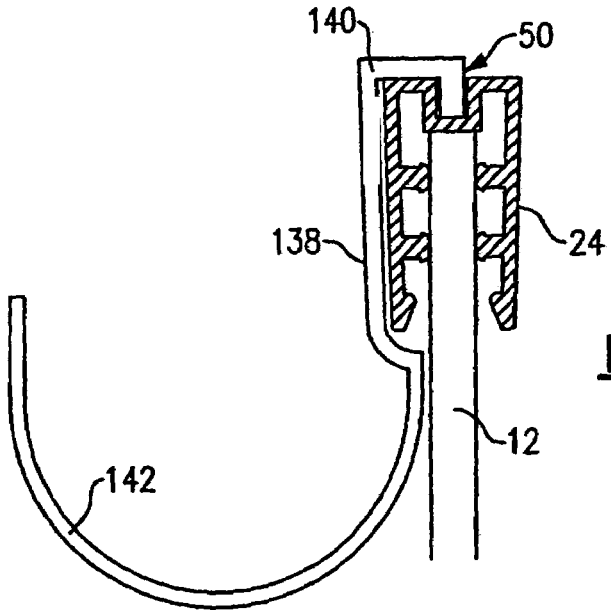
FIG. 12 is a cross-sectional view of an accessory tray that may be used with a white board of the present invention.

With reference to FIG. 12, if using white board 12 without frame 18, an accessory tray 138 may be employed. Accessory tray 138 includes a hook shaped connecting member 140 that engages the channel 50, 52, 54, or 56, and a curved accessory holding tray 142.

While the present invention has been described in respect of its preferred embodiment, it should be understood that modifications may be made while remaining within the full scope and spirit of the present invention as defined by the appended claims.

What is claimed is:

1. A writing board, comprising:

a) first and second opposed, planar surfaces at least one of which is suitable for writing on and being defined by a predetermined periphery; and b) a trim secured to and extending substantially fully about said predetermined periphery of said first and second writing surfaces, said trim including a channel formed longitudinally therein along at least a portion of its length;

c) wherein said channel is adapted to securely receive and retain in fixed relation to said trim a predetermined board accessory;

d) wherein said trim has an inwardly facing first edge proximate to said planar surfaces and an outwardly facing second edge opposite from said first edge, and said channel is formed on said outwardly facing second edge of said trim.

2. The writing board of claim 1, wherein said predetermined periphery is rectangular, and said trim includes first, second, third, and fourth legs extending along each side of said rectangular periphery, each of said legs being adjoined to adjacent legs by a connector positioned at each corner of said rectangular periphery.

3. The writing board of claim 2, wherein each of said first, second, third, and fourth legs includes a respective channel formed in their outwardly facing surfaces and extending longitudinally there along.

4. The writing board of claim 2, wherein said connectors each include means for interconnecting the writing board to a second writing board.

5. The writing board of claim 4, wherein said means for interconnecting the writing board to a second writing board comprises pile fabric mounted on a first surface of each of said connectors and hook fabric mounted on an opposing surface of each of said connectors.

6. The writing board of claim 4, wherein said means for interconnecting the writing board to a second writing board comprises a snap mounted on a first surface of each of said connectors and a snap receiver mounted on an opposing surface of each of said connectors.

7. The writing board of claim 1, wherein said predetermined board accessory is selected from the group consisting of: a handle, a mounting block, an open tray, and an index tab.

8. The writing board of claim 7, wherein said predetermined board accessory is an index tab that comprises an elongated strip of material having a t-shaped crosssectional profile.

9. The writing board of claim 7, wherein said predetermined accessory is a handle that includes a pair of openings formed through its opposite ends and said handle is attached to said trim by a pair of thumb screws that pass through said pair of openings and into correspondingly positioned, internally threaded bored holes formed in said trim.

10. The writing board of claim 9, further including a mounting block clampingly positioned between said handle and said trim when said handle is attached to said trim.

11. The writing board of claim 10, wherein said mounting block includes a pair of laterally positioned holes formed therethrough.

12. The writing board of claim 1, further comprising at least one fin attached to at least one of said first and second planar surfaces, said fin adapted to retain a predetermined item in contacting relation to said at least one of said first and second surfaces.

13. The writing board of claim 12, wherein said predetermined item is selected from the group consisting of: papers, laminated papers, posters, maps, presentations, calendars, placards, signage, wall planners, and pictures.

14. A writing board system, comprising:

a) a frame adapted for static connection to a vertical surface;

b) at least one board comprising first and second opposed, planar surfaces defined by a predetermined periphery, a trim secured to and extending a length along at least a portion of said predetermined periphery, said trim including a channel formed longitudinally therein along at least a portion of its length, wherein said channel is adapted to securely receive and retain a predetermined board accessory, wherein said trim has an inwardly facing first edge proximate to said planar surfaces and an outwardly facing second edge opposite from said first edge, and said channel is formed on said outwardly facing second edge of said trim; and c) a board mounting member comprising a first portion adapted for secure connection to said frame and a second portion adapted to retain said at least one board in fixed relation to said frame.

15. The writing board system of claim 14, wherein said board mounting member comprises an S-shaped mounting block, said first portion being a first channel member adapted to engage and connect to said frame, and said second portion being a second channel member adapted to receive said at least one board therein.

16. The writing board system of claim 14, further comprising an accessory tray adapted for interconnection to said frame.

17. The writing board system of claim 16, wherein said accessory tray comprises a first channel member adapted for connection to said frame, a second channel member adapted to receive said at least one board therein, and a tray portion extending forwardly from said second channel member and adapted to hold a predetermined item thereon.

18. The writing board system of claim 17, wherein said predetermined item is selected from the group consisting of: markers and erasers.

19. The writing board system of claim 14, wherein said frame comprises a plurality of leg members defining the periphery of sad frame and at least one board securing member attached to at least one of said legs.

20. The writing board system of claim 19, wherein said at least one board securing member is selected from the group consisting of: magnets, hook fabric, and pile fabric.

21. The writing board system of claim 14, further comprising means for hanging said frame on said vertical surface.

22. The writing board system of claim 21, wherein said means for hanging said frame on said vertical surface comprises mounting brackets that include a hook portion for engaging an upper edge of said vertical surface and a leg portion for connecting to said frame.

23. The writing board system of claim 22, wherein the spacing between said hook portion and said leg portion of said mounting brackets is adjustable.

24. A board, comprising:

a) first and second opposed, planar surfaces defined by a predetermined periphery; and b) a trim secured to and extending a length along at least a portion of said predetermined periphery, said trim including a channel formed longitudinally therein along at least a portion of its length;

c) wherein said channel is adapted to securely receive and retain a predetermined board accessory;

d) wherein said trim has an inwardly facing first edge proximate to said planar surfaces and an outwardly facing second edge opposite from said first edge, and said channel is formed on said outwardly facing second edge of said trim.

25. A board system, comprising:

a) a frame adapted for static connection to a vertical surface;

b) at least one board comprising first and second opposed, planar surfaces defined by a predetermined periphery, a trim secured to and extending a length along at least a portion of said predetermined periphery, said trim including a channel formed longitudinally therein along at least a portion of its length; wherein said channel is adapted to securely receive and retain a predetermined board accessory; wherein said trim has an inwardly facing first edge proximate to said planar surfaces and an outwardly facing second edge opposite from said first edge, and said channel is formed on said outwardly facing second edge of said trim, and c) a board mounting member comprising a first portion adapted for secure connection to said frame and a second portion adapted to retain said at least one board in fixed relation to said frame.

* * * * *